US007028659B2

(12) United States Patent
Schneider

(10) Patent No.: US 7,028,659 B2
(45) Date of Patent: Apr. 18, 2006

(54) METHOD FOR ADJUSTING A VOLUMETRIC FLOW-VARIABLE POSITIVE DISPLACEMENT PUMP IN AN INTERNAL COMBUSTION ENGINE

(75) Inventor: Willi Schneider, Bodelshausen (DE)

(73) Assignee: Joma-Hydromechanic GmbH, Bodelshausen (DE)

( * ) Notice: Subject to any disclaimer, the term of this patent is extended or adjusted under 35 U.S.C. 154(b) by 0 days.

(21) Appl. No.: 10/501,531

(22) PCT Filed: Feb. 22, 2002

(86) PCT No.: PCT/EP02/01893

§ 371 (c)(1),
(2), (4) Date: Jul. 16, 2004

(87) PCT Pub. No.: WO02/093013

PCT Pub. Date: Nov. 21, 2002

(65) Prior Publication Data

US 2005/0118033 A1 Jun. 2, 2005

(30) Foreign Application Priority Data

May 14, 2001 (DE) ..... 101 24 564

(51) Int. Cl.
*F04B 49/00* (2006.01)
*F01M 1/00* (2006.01)

(52) U.S. Cl. ..... 123/196 R; 417/213

(58) Field of Classification Search ..... 123/196 R, 123/73 AD; 417/213, 32, 34, 416, 417; 184/6.5, 184/7.4

See application file for complete search history.

(56) References Cited

U.S. PATENT DOCUMENTS

| | | | | |
|---|---|---|---|---|
| 5,390,635 | A * | 2/1995 | Kidera et al. | 123/196 R |
| 5,690,479 | A | 11/1997 | Lehmann | |
| 5,800,131 | A | 9/1998 | Lehmann | |
| 5,921,758 | A * | 7/1999 | Anamoto et al. | 417/416 |

FOREIGN PATENT DOCUMENTS

| | | |
|---|---|---|
| DE | 38 40 909 | 6/1989 |
| DE | 42 01 257 | 7/1993 |
| DE | 690 04 800 | 5/1994 |
| DE | 692 14 774 | 2/1997 |
| DE | 195 33 686 | 3/1997 |
| DE | 198 37 275 | 3/2000 |
| DE | 199 56 267 | 5/2000 |
| DE | 199 15 738 | 10/2000 |
| EP | 0 457 365 | 11/1991 |
| EP | 0 573 734 | 12/1993 |
| EP | 1 043 504 | 10/2000 |

* cited by examiner

*Primary Examiner*—Henry C. Yuen
*Assistant Examiner*—Hyder Ali
(74) *Attorney, Agent, or Firm*—Paul Vincent

(57) ABSTRACT

The invention relates to a method for adjusting a volumetric flow-variable positive displacement pump in an internal combustion engine involving the following method steps: operating the positive displacement pump; delivering the fluid to the consumption points in the internal combustion engine; determining at least one characteristic value of the internal combustion engine; forwarding this characteristic value as an actual value signal to a control device; comparing the actual value signal with a predetermined set-point value; preparing an actuating signal from the difference between the actual signal and the set-point value; feeding the actuating signal to an actuator; using the actuator to alter the volumetric flow of the positive displacement according to the actuating signal; repeating the method steps until the actual value signal is equal to the set-point value.

10 Claims, 1 Drawing Sheet

METHOD FOR ADJUSTING A VOLUMETRIC FLOW-VARIABLE POSITIVE DISPLACEMENT PUMP IN AN INTERNAL COMBUSTION ENGINE

This application is the national stage of PCT/EP02/01893 filed on Feb. 22, 2002 and also claims Paris Convention priority of DE 101 24 564.5 filed on May 14, 2001.

BACKGROUND OF THE INVENTION

The invention relates to a method for adjusting a volumetric flow-variable positive displacement pump in an internal combustion engine.

Such positive displacement pumps are used in internal combustion engines chiefly as lubricant pumps for oil lubrication (e.g., U.S. Pat. No. 5,800,131). It is known that the adjustment of such positive displacement pumps is effected either mechanically, hydraulically, mechanically-hydraulically or electro-hydraulically. Adjustment of a volumetric flow-variable positive displacement pump is understood as meaning the reduction or increase of its displacement space. For this purpose, in a volumetric flow-variable vane pump, the axial offset of the rotating rotor relative to the center of the pump is changed in such a way that the individual displacement spaces present between the vanes are increased or reduced. The changing of the axial offset is referred to as adjustment. The adjustment of a pump is carried out when either the plant pressure is to be varied or the delivery has to be adapted.

It is the object of the invention to provide a method by means of which a volumetric flow-variable positive displacement pump can be optimally adapted to changing needs of an internal combustion engine.

SUMMARY OF THE INVENTION

This object is achieved, according to the invention, by a method which has the features of claim 1.

In this method according to the invention, a marked characteristic of the internal combustion engine is determined and, depending on the deviation of this characteristic from an actual value signal, the positive displacement pump is adjusted until the characteristic has been made equivalent to the setpoint value. The suction pressure ($p_S$), the delivery pressure ($p_L$), the speed (n) of the internal combustion engine and/or of the positive displacement pump, the temperature (T) of the fluid and/or the delivery rate (Q) of the fluid can be determined as the characteristic. This means that it is also possible to have a plurality of different characteristics to determined and, depending on this plurality of characteristics, the positive displacement pump can be controlled. The plurality of characteristics can be polled simultaneously or successively. Moreover, the setpoint value can be made available in the form of setpoint value ranges so that only a deviation of a certain magnitude leads to an adjustment of the positive displacement pump. This can be set in such a way that, for example, a deviation of 5% from the setpoint value leads to an adjustment of the positive displacement pump, whereas deviations below this limit are not taken into account.

Another variant provides for a change of the volumetric flow only when the adjusting signal changes by a certain value. This may be 5% or 10%.

The motor control computer which is already present and in which a large number of characteristic data are already processed can be used as a controller. The motor control computer then need only be supplemented with the data of the positive displacement pump and the calculation rules for the setpoint value/actual value comparison and for the signal generation. Thus, there is no need for either additional sensors or additional cables, so that relatively few components are required.

The final control element is preferably actuated against a restoring force. The delivery volume of the positive displacement pump is reduced thereby. This has the substantial advantage that, on failure of the control chain of an individual component, the positive displacement pump is adjusted to maximum volumetric flow by means of the restoring spring which resets the positive displacement pump to the starting position.

Further advantages, features and details of the invention are evident from the following description, in which a particularly preferred embodiment is described in detail with reference to the drawing. The features shown in the drawing and mentioned in the description and in the claims may be essential to the invention either individually or in any desired combination. The drawing shows a circuit diagram of a preferred embodiment of the invention.

BRIEF DESCRIPTION OF THE DRAWING

The sole FIGURE shows a schematic block diagram of the positive displacement pump and internal combustion engine in accordance with the invention

DESCRIPTION OF THE PREFERRED EMBODIMENT

Figure 1:
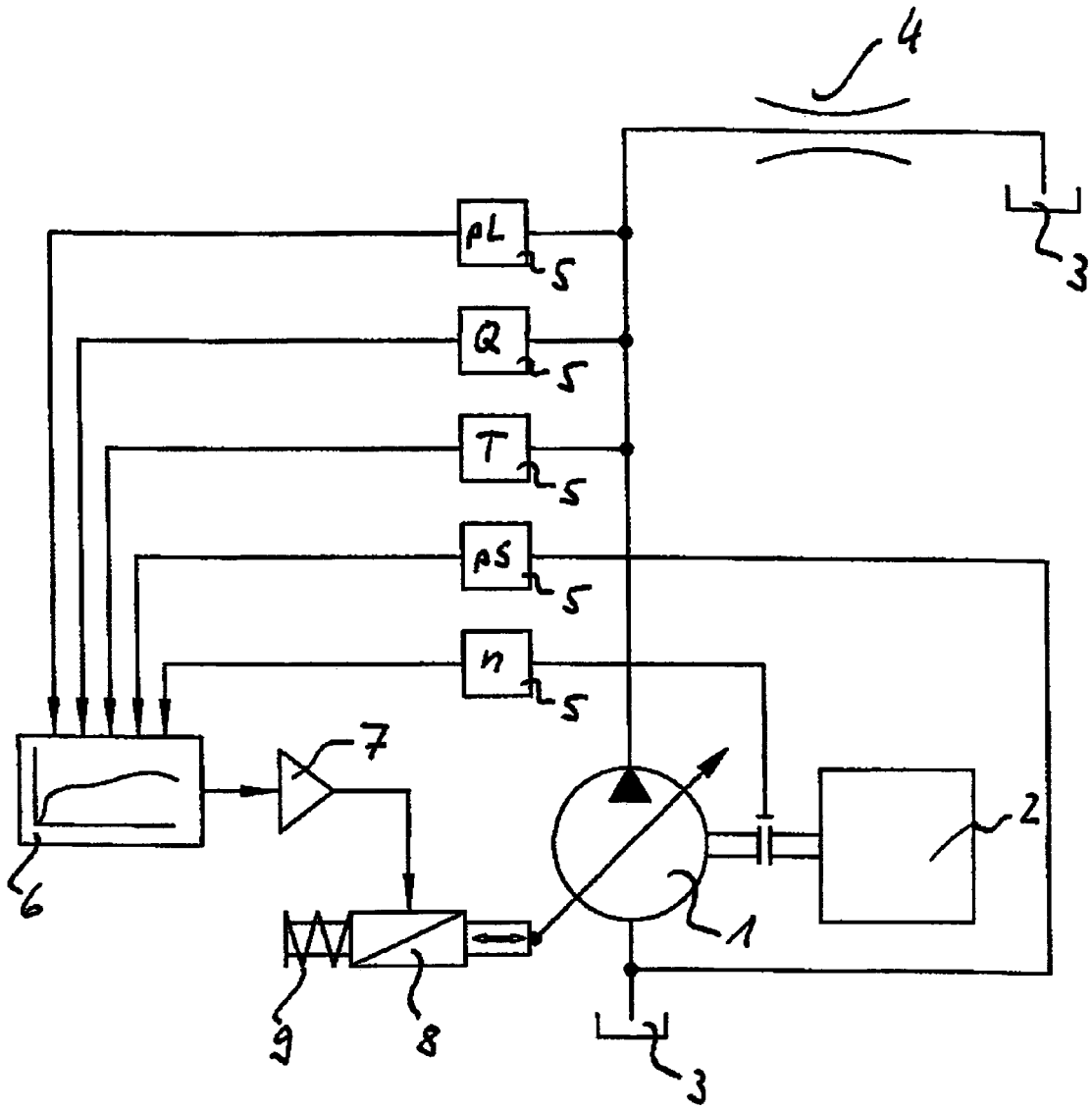

A positive displacement pump which is driven by an internal combustion engine 2 is denoted by the reference numeral 1. The positive displacement pump 1 suctions the oil from an oil sump 3 and delivers it to a large number of lubricant points 4 in the internal combustion engine 2, of which only one is shown. The oil runs from the lubricant points 4 back into the oil sump 3.

The method according to the invention makes use of the measuring points 5 present in the engine system for determining the delivery pressure PL, the delivery rate Q, the temperature T, the suction pressure $p_S$ and the speed n as actual value signals for processing in a controller 6. The sensors already present and laid cables are used. Moreover, the motor control computer already present is used and optionally supplemented. Required data for the measuring points 5 for the respective operating state of the engine are stored in this controller 6 for the operating range of the engine 2. The actual value signals determined at the measuring points 5 are compared in the controller with the required data stored there. In the controller 6, an adjusting signal is generated from the deviations between the actual values and the setpoint values and is transmitted via a signal transmitter 7 to a final control element 8. An increase or reduction of the displacement space of the positive displacement pump 1 is effected by the final control element 8 on the basis of the adjusting signal until the actual value signals at the measuring points 5 correspond to the setpoint value signals in the controller 6. Suitable control systems are used for this purpose.

It should be pointed out that the measuring points 5 shown in the drawing can be used, but that it is also possible to use fewer measuring points 5 or further additional measuring points 5. The controller 6 may be present as an individual apparatus or, as mentioned above, it is integrated in the motor control computer. In this case, it is merely necessary to additionally store data for the positive displacement pump 1 and the calculation rules for the setpoint value/actual value comparison and the signal control generation. The signal transmitter 7 can likewise be in the form of an individual apparatus, or it is integrated into the controller 6 or into the final control element 8.

The final control element 8 is in the form of a discrete component or is already integrated in the positive displacement pump 1. The final control element 8 contains a restoring spring 9 which opposes the direction of adjustment and serves, on failure of the control chain formed from the measuring points 5, the controller 6, the signal transmitter 7 and the final control element 8, or of an individual component thereof, for ensuring the adjustment of the positive displacement pump 1 to the greatest chamber volume. Malfunctions and undersupply of the internal combustion engine 1 with lubricant are thereby avoided.

I claim:

1. A method for adjusting a volumetric flow-variable positive displacement pump in an internal combustion engine, the method comprising the steps of:

a) driving the positive displacement pump;

b) transporting fluid to consumption points in the internal combustion engine;

c) determining at least one characteristic of the internal combustion engine;

d) transmitting said characteristic as an actual value signal to a controller;

e) comparing said actual value signal with a predetermined setpoint value;

f) generating an adjusting signal from a deviation between said actual value signal and said setpoint value;

g) feeding said adjusting signal to a final control element;

h) changing an internal pump volume of the positive displacement pump by means of said final control element as a function of said adjusting signal; and i) repeating steps a) through h) until said actual value signal is the same as said setpoint value.

2. The method of claim 1, wherein said at least one characteristic is at least one of a suction pressure, a delivery pressure, a speed of the internal combustion engine, a speed of the positive displacement pump, a temperature of the fluid, and a delivery rate of the fluid.

3. The method of claim 1, wherein said setpoint value comprises a setpoint value range.

4. The method of claim 1, wherein the volumetric flow is changed only when said adjusting signal exceeds a threshold value.

5. The method of claim 1, wherein a multi-purpose motor control computer is used as said controller.

6. The method of claim 5, wherein said motor control computer is supplemented with positive displacement pump data and calculation rules for said setpoint value comparison with said actual value and for generation of said adjusting signal.

7. The method of claim 1, wherein said final control element is actuated against a restoring force.

8. The method of claim 7, wherein said restoring force is generated by a restoring spring.

9. The method of claim 1, wherein a delivery volume of the positive displacement pump is reduced on actuation of said final control element.

10. The method of claim 1, wherein the positive displacement pump is adjusted to maximum volumetric flow upon failure of a control chain or of an individual component.

* * * * *